United States Patent [19]

Cerny et al.

[11] 4,336,930

[45] Jun. 29, 1982

[54] SHEET TRANSFER ATTACHMENT

[75] Inventors: Arnost Cerny, Blansko; Jiri Fiser, Adamov; Jaroslav Jiruse, Blansko; Vaclav Sedlak, Jedovnice, all of Czechoslovakia

[73] Assignee: Adamovske strojirny, narodni podnik, Prague, Czechoslovakia

[21] Appl. No.: 197,188

[22] Filed: Oct. 15, 1980

[30] Foreign Application Priority Data

Oct. 15, 1979 [CS] Czechoslovakia ..... 6959-79

[51] Int. Cl.[3] ..... B65H 29/06

[52] U.S. Cl. ..... 271/277; 271/82; 101/409

[58] Field of Search ..... 101/408, 409, 410; 271/82, 277, 268

[56] References Cited

U.S. PATENT DOCUMENTS

| | | | |
|---|---|---|---|
| 2,130,977 | 9/1938 | Timson | 271/268 |
| 4,120,244 | 10/1978 | Wirz | 101/409 X |
| 4,202,268 | 5/1980 | Becker | 101/409 |

*Primary Examiner*—Richard A. Schacher

*Attorney, Agent, or Firm*—Burgess, Ryan and Wayne

[57] ABSTRACT

The invention relates to a sheet transfer device, for offset printing machines which print on one side of the sheet or on both sides of the sheet of paper, having a means for adjustment to accommodate sheets of different sizes, achieving thereby an accurate register printing.

The feature of the device according to the invention is a reset wheel of the sheet transfer drum which is adjustably mounted on a centering flange, on rollers rotatably mounted on eccentric pins mounted in the centering flange. The centering flange has rotatably mounted eccentrics, which bear on carrying projections of the transfer drum body, while the transfer drum reset wheel is fastened to the flange. The clearance between the reset wheel and the flange centering diameter is adjusted by eccentric pins, while at the same time the reset wheel is centered so that its gearing is precisely centered with the transfer drum axis. The clearance of the toothing of the reset wheel is taken up by take-up segments. The setting of the centering flange centricity and taking up the clearance of the reset wheel to flange centering diameter is done independently.

2 Claims, 3 Drawing Figures

SHEET TRANSFER ATTACHMENT

BACKGROUND OF THE INVENTION

The invention relates to a sheet transfer device which can be reset according to the size of printed sheets and which achieves accurate registration on printing machines for one and two sided printing.

The present device achieves automatic size resetting on the turning and transfer drum without affecting the registration accuracy. The reset wheel of the transfer drum performs the function of the gripping device drive wheel which stretches the sheets on the transfer drum.

Registration of two sided printing depends on the sheet transfer drum, accuracy, i.e., the way of sheet turning.

The invention is an attachment for performing sheet transfer from the transfer to the turning drum during printing accurately and consistently. In this way, a high registration accuracy in two-sided printing may be achieved.

Moreover, the invention is a reset wheel which makes it possible to eliminate production inaccuracies and to reset it to be accurately centric with the transfer drum axis.

The reset wheel is designed in a way to ensure its easy resetting, according to the size of the printed sheets, with the ability to take up clearances. Setting up according to the size of printed sheets and the centricity of reset gear rim can be accomplished independently.

One of the known devices is arranged in such a manner that when resetting the printing machine for change of printed sheet size in two sided printing, it is necessary to reset the transfer drum and the turning roll separately. At the same time, the coherent mechanisms are to be reset, too.

A disadvantage of this attachment is that it necessitates that each mechanism be reset independently. Inaccuracies can arise by not resetting the same value on the transfer and turning drum according to the size of printed sheets.

Another known device comprises a transfer drum having a reset wheel attached to the gripping device for stretching and transferring of sheets by means of carrying pins.

The reset wheel engages the turning drum gear and resetting of transfer and turning drum is done at the same time.

A disadvantage of the device is that it neither allows for adjustment of the reset wheel centricity, nor enables setting up of clearance between the supporting flange and the reset gear. Another disadvantage is the inability to take up the reset wheel clearance.

A printing machine having two printing units and transfer and turning cylinders is described in U.S. Pat. No. 3,829,084, the contents of which are incorporated herein by reference.

BRIEF SUMMARY OF THE INVENTION

The disadvantages are eliminated by the device of the present invention, the substance of which comprises a transfer reset wheel adjustably positioned on the flange centering diameter, on rollers which rotate on eccentric pins swivelly mounted on the flange, in which, by means of their pins, are rotatively mounted on the eccentrics, which bear on carrying projections of the transfer drum body, while the transfer drum reset wheel is fixed to the flange by means of screws. The flange is, by means of screws, adjustably fitted to the end wall of transfer drum body carrying the gripping devices for stretching of the sheets, while the reset wheel fitted with take up segments is in mesh with the turning roll gear.

An advantage of the present device is the ability to set up, by means of eccentrics, the centering diameter so that it is centric with the transfer drum axis. The clearance between the reset wheel and the flange centering diameter is taken up by eccentric pins while, at the same time, the reset wheel is centered in order for its gearing to be precisely centric with the transfer drum axis.

A further advantage of the present device is that the taking up of gearing clearance is accomplished by taking up segments which allow adjustment for each gripping device separately. The segments operate on the back edge of the sheet in transport of the sheets from the transfer to the turning drum. The setting up of centering diameter centricity and taking up of reset wheel to flange centering diameter is done independently.

A further advantage of the present device is elimination of production inaccuracies and ensuring accurate registration in two sided print.

DETAILED DESCRIPTION OF THE INVENTION

In printing machines capable of two sided printing, registration becomes difficult in view of turning of the sheets of paper. Accurate registration becomes even more difficult when the printing machine must accommodate sheets of paper of varying length. In a known arrangement, the front edge of the sheet of paper is held by holding means which are fixedly arranged on the transfer drum and the back edge of the sheet of paper is held by holding means which are movably arranged so that they may be positioned at varying distances from the front edge holding means to accommodate sheets of paper having different lengths. Since the paper is transferred from the transfer drum to the turning drum, it is necessary to provide means for adjusting the transfer means of the turning drum to engage the back edge of the sheet of paper at the proper time. To insure precise turning, it is necessary to provide means for adjusting engagement of the gear so that backlash can be reduced and tight engagement of the gears insured. Backlash must be reduced as much as is practical to accomplish accurate transfer between the turning drum and the transfer drum.

Figure 1:
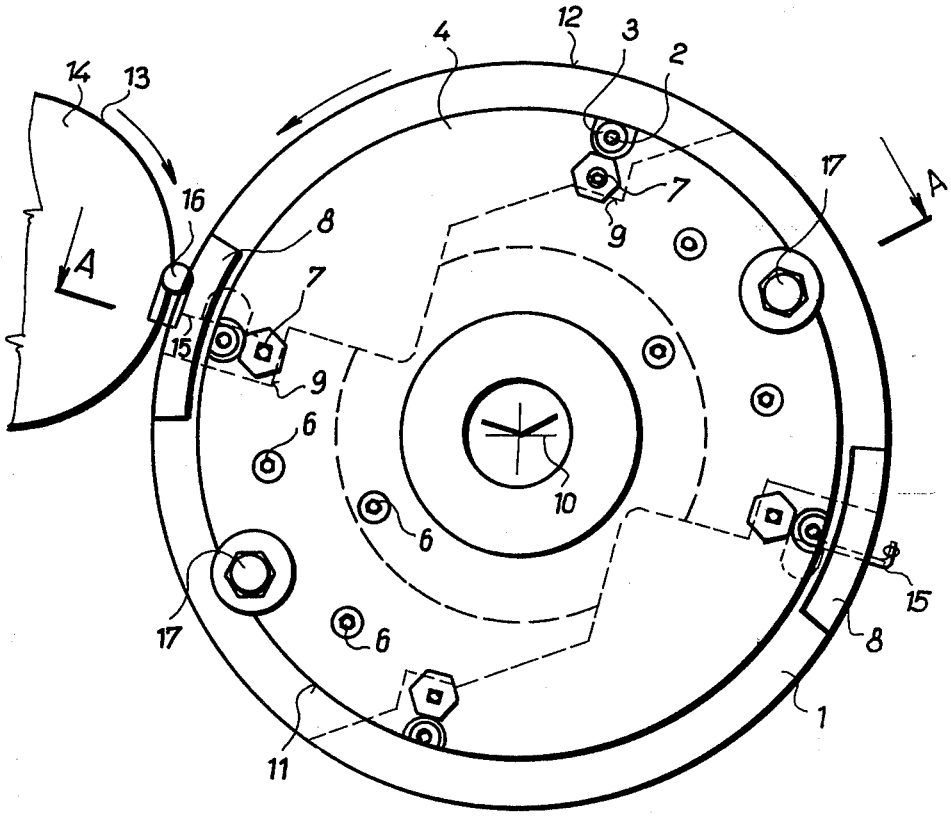
FIG. 1 is a side view of the sheet transfer device.
Figure 2:
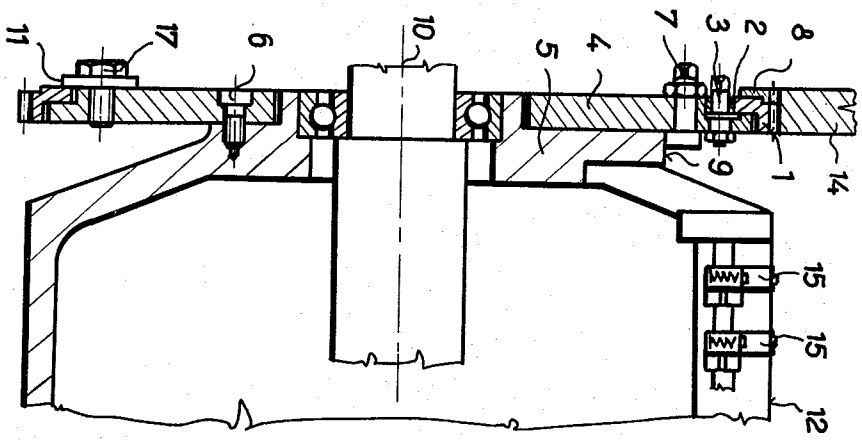
FIG. 2 is a broken out view through A—A of FIG. 1.
Figure 3:
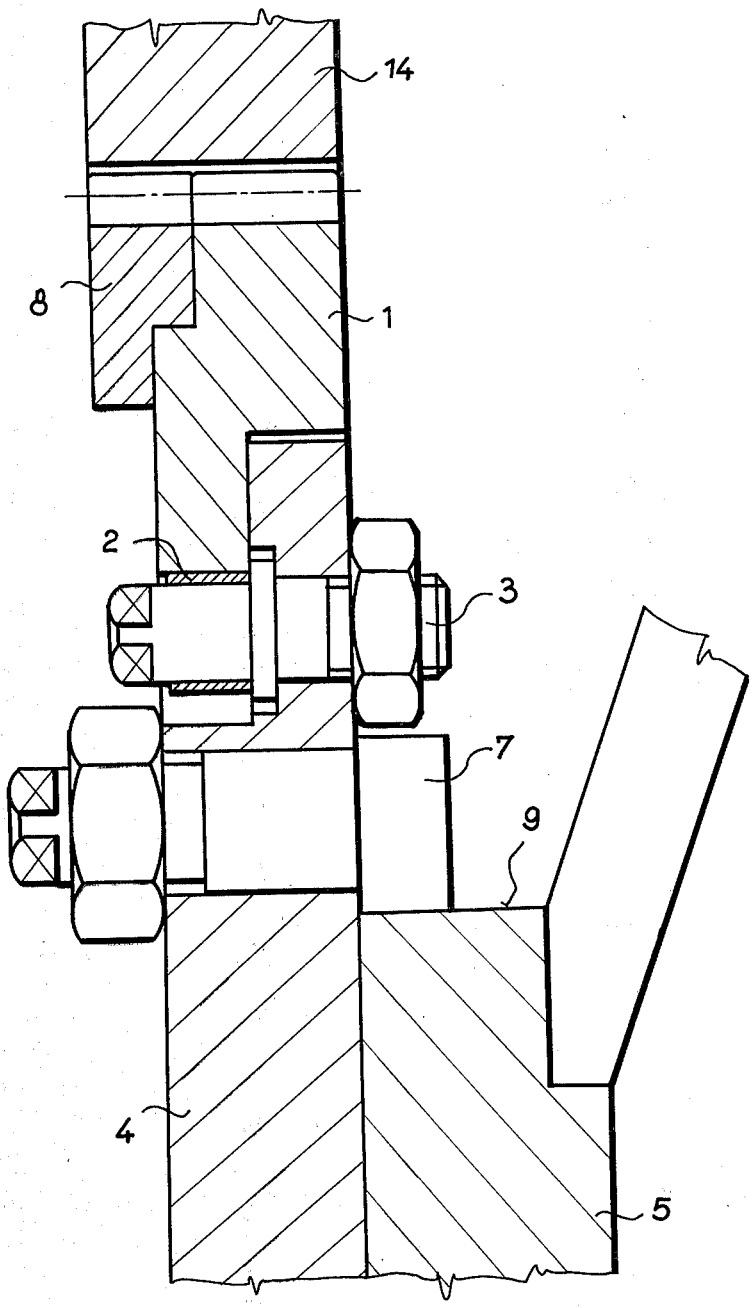
FIG. 3 is a detail view of the eccentrics and eccentric pins for carrying out adjustment of the reset drum transfer wheel.

The sheet transfer device according to the invention comprises a reset gear wheel (1), which is revolvingly mounted on the flange (4) centering diameter (11) and adjustably bedded on rollers (2). The rollers (2) can rotate on eccentric pins (3), which swivel in flange (4). The flange (4) is centered about the axis (10) of eccentrics (7) which bear on projections (9) (see FIG. 3), shaped on the transfer drum body (12). The eccentrics (7) are adjustably attached to the flange (4). The transfer drum (12) has a diameter twice the diameter of the turning drum (13). On the transfer drum (12) are placed opposite shafts with gripping devices (15) which transfer the sheets held in the spring collet device (16) of the turning drum (13). The turning drum (13) is fitted with a gear (14) which engages with reset wheel (1) of the flange (4). The gripping devices (15) are joined to the reset wheel (1) fitted with taking up segments (8). The reset wheel (1) is attached to the flange (4) by means of clamp screws (17). The gearing of the reset wheel (1) is centric with the transfer drum axis (12,10). The flange (4) is adjustably joined by means of screws (6) to the end wall of the transfer drum body (12, 5).

The function of the present attachment is as follows: during two sided printing, the driven sheets are stretched on transfer drum body (5) by means of gripping devices (15) and further transferred, back edge ahead, in the turning drum (13) spring collet device (16). Following the transfer, the device is reset to the next transfer. The transfer drum reset wheel (12,1) engages with the turning drum gear (14, 13) the gearing clearance being taken up on the sheet transferring phase by toothed take up segments (8). The segments' taking up is done for each gripping device (15) individually.

The setting up of the flange (4) is performed after releasing of screws (6) by turning eccentrics (7) which bear on projections (5) on the transfer drum body (12). In this way, the centering diameter (11) of the flange (4) is set to be accurately centric with the transfer drum axis (10, 12). Then the flange (4) is joined to the transfer drum body (12, 5) by means of screws (6).

After releasing of the clamp screws (17), the reset wheel (1) clearance on the flange (4) centering diameter (11) is further taken up by turning of the eccentric pins (3) fitted with rollers (2).

In this same time, the reset wheel (1) is to be centered so that its gearing is accurately centric with the transfer drum axis (12, 10).

The resetting of said device because of printed sheets size change is to be performed by releasing the clamp screws (17) and resetting the gripping devices (15) by means of reset wheel (1) which is to be rotated by the known mechanism.

1—reset wheel
2—roller
3—eccentric pin
4—flange
5—body
6—screw
7—eccentric
8—take up segment
9—projection
10—axis
11—centering diameter
12—transfer drum
13—turning drum
14—gear
15—gripping device
16—collet spring attachment
17—clamp screws

We claim:

1. A sheet transfer device for printing machines having sheet turning means comprising a transfer drum having a transfer body, a reset drive gear wheel and paper gripping means and a turning drum having gears and paper gripping means wherein the reset gear wheel comprises a gear wheel adjustably mounted on eccentric pins rotatably mounted in a centering flange having eccentrics for centering the centering flange, adjustably mounted in the centering flange, which bear against the transfer drum body and means for attaching the reset gear wheel to the transfer drum body.

2. The device of claim 1, comprising a reset gear wheel having take up segments, said gear wheel being adapted to be attached to the transfer drum body when the take up segment is in mesh with the gears of the turning drum.

* * * * *